United States Patent [19]

Kopplin

[11] 3,941,961

[45] Mar. 2, 1976

[54] CONTACT ARRANGEMENT FOR A VACUUM SWITCH

[75] Inventor: Horst Kopplin, Berlin, Germany

[73] Assignee: Siemens Aktiengesellschaft, Munich, Germany

[22] Filed: Oct. 3, 1974

[21] Appl. No.: 511,712

[30] Foreign Application Priority Data

Oct. 18, 1973 Germany ..... 2352540

[52] U.S. Cl. ..... 200/144 B

[51] Int. Cl.[2] ..... H01H 33/66

[58] Field of Search ..... 200/144 B

[56] References Cited

UNITED STATES PATENTS

| | | | |
|---|---|---|---|
| 3,211,866 | 10/1965 | Crouch et al. | 200/144 B |
| 3,711,665 | 1/1973 | Dethlefsen | 200/144 B |
| 3,818,164 | 6/1974 | Mizutani et al. | 200/144 B |
| 3,836,740 | 9/1974 | Hundstad | 200/144 B |

FOREIGN PATENTS OR APPLICATIONS

| | | | |
|---|---|---|---|
| 125,461 | 11/1931 | Austria | 200/144 B |

*Primary Examiner*—Robert S. Macon
*Attorney, Agent, or Firm*—Kenyon & Kenyon Reilly Carr & Chapin

[57] ABSTRACT

A contact arrangement for a vacuum switch includes contacts which have central contact surfaces and arc running surfaces surrounding the central contact surfaces. Means are provided to direct current to the area of the central contact surfaces as well as to the area of the arc running surfaces. As the arc foot points approach the edge of the contacts, forces become effective which prevent the arc from leaving the area between the contacts.

7 Claims, 3 Drawing Figures

CONTACT ARRANGEMENT FOR A VACUUM SWITCH

BACKGROUND OF THE INVENTION

The opening operation in vacuum switches is initiated by the separation of the interacting contacts. During this process, there arises a metal vapor arc having foot points which should be put into motion to limit the burning of the contact pieces. In known contacts, this is accomplished by separate arc contact surfaces which surround the actual contact surfaces and which may be provided with slots to form guiding edges for the arc foot points. The contact pieces may then be constructed so that a rotation of the switching arc about the axis of the contact arrangement results.

Until now, efforts were directed to bringing about a radial expansion of the arcs by the utilization of loop forces. For example, the U.S. Pat. No. 3,211,866 describes a contact arrangement wherein concentric contact pieces are opened successively to increase the current loop. Such measures, however, may lead to the arcs leaving the area between the contacts and making contact with the vapor shields surrounding the contact arrangement. This may not only damage the vapor shields, but may also reduce the overall circuit-breaking capacity of the vacuum switch.

SUMMARY OF THE INVENTION

It is an object of the invention to avoid the above-mentioned disadvantageous phenomena.

The object of the invention is achieved by a contact arrangement for a vacuum switch which includes contact members which can be moved relative to each other and which have central contact surfaces as well as arc running surfaces surrounding the central contact surfaces. According to a feature of the invention, the central contact surfaces and the arc running surfaces are supplied with first and second current conducting means respectively. This configuration establishes the condition that as the arc foot points migrate in radial direction, the current forces going away from the center are increasing in the beginning, but that forces in central direction become effective when the arc foot points approach the edge of the contacts. Therefore, no current forces can occur to drive the arcs out of the area between the contacts.

The second current conducting means can be a current conducting structure for supplying current to the edges of the arc running surfaces. The desired effect may be influenced by the appropriate selection of the cross-section and the conductivity of the means connected to the edge of the contacts. These means may be constructed in the form of a conducting part of annular profile disposed between the support of each contact and the outer rim of the arc running surface.

The effect of supplying current at the edge of the arc running surfaces can be further improved according to a subsidiary feature of the invention by providing an annular gap that separates the central contact surfaces from the arc running surfaces surrounding central contact surfaces. The consequence of the gap is that the current is supplied to the arc through the edge of the arc contact surfaces only when the arc foot points have jumped from the central contact surfaces to the arc running surfaces. This arrangement does not require the annular gap to be directly adjacent to the central contact surface. It may, rather, be beneficial to provide the annular gap a lesser or greater distance away from the central contact surface.

Furthermore, the arc contact surfaces may be provided with helical cuts terminating in the annular gap. This establishes guiding edges for the arc foot points which promote a motion of the arc in circumferential direction. In addition, the arc contact surface is divided into several fields so that the current is supplied to the arc only through the edge zone of the particular field in which the foot point of the arc is located.

Although the invention is illustrated and described herein as a contact arrangement for a vacuum switch, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
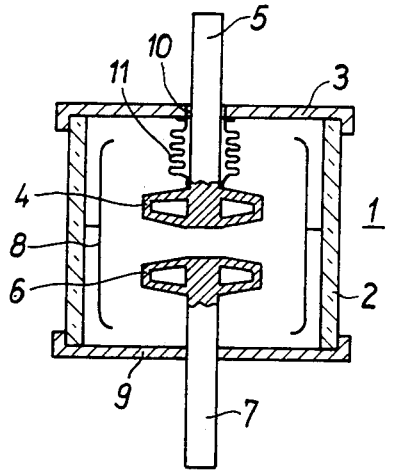
FIG. 1 is a schematic diagram, partially in section, showing a vacuum switch equipped with a contact arrangement according to the invention. The contact arrangement according to the invention is especially suitable for vacuum switches operable in the medium voltage range.

The vacuum switch 1 in FIG. 1 has a hollow-cylindrical housing 2 made of a suitable insulating material such as glass or porcelain closed at its upper end by a metal cap 3 and at its lower end by another metal cap 9. On the longitudinal axis of the switch vessel are disposed a movable contact piece 4 with a carrier in the form of a supporting pin 5 and a fixed contact piece 6 with another supporting pin 7. The supporting pin 5 of the movable contact piece 4 is movably guided in an opening 10 of the upper cap 3. A bellows 11 fastened to the supporting pin 5 and to the cap 3 serves as a sealing means. The supporting pin 7 of the fixed contact 6 is joined rigidly and vacuum-tight to the cap 9. The contacts 4 and 6 are surrounded by a vapor shield 8 mounted concentrically with respect thereto.

Figure 2:
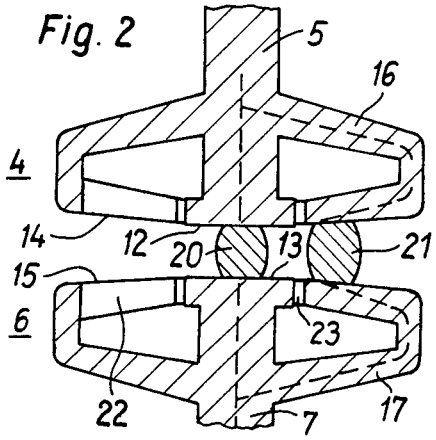
FIG. 2 is an exploded view of the contact arrangement according to the invention. The left hand portion of the contact pieces is shown in section along the line II—II in FIG. 3.

The contacts 4 and 6 shown separately in FIG. 2 have central contact surfaces 12 and 13, respectively, which, in the closed position of the contact arrangement, make contact with each other and carry the continuous current. The adjacent arc running surfaces 14 and 15 corresponding to contacts 4 and 6, respectively, extend outwardly and form conical surfaces which function to take over the arc after its foot points have left the central contact surfaces 12 and 13. The current is supplied, on the one hand, through first current conducting means in the form of the full cross-section of the supporting pins 5 and 7 to the central contact surfaces 12 and 13 and, on the other hand, through second current conducting means in the form of bypasses of annular section to the edges of the arc running surfaces 14 and 15. This purpose is served by bell-shaped parts 16 and 17 which are connected to the supporting pins 5 and 7. Accordingly, each contact has the shape of a disc becoming thinner towards the edge, with an internal, annular cavity.

Figure 3:
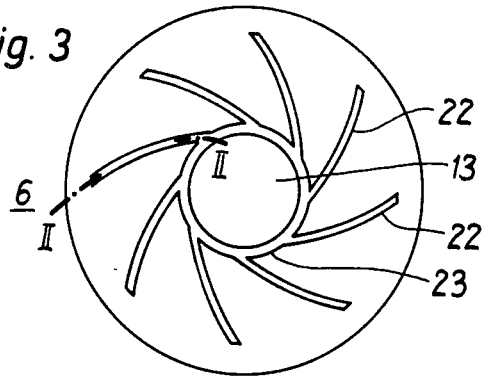
FIG. 3 is a plan view of one of the contact pieces showing helical cuts formed in the arc running surface according to a subsidiary embodiment of the invention.

As shown in FIGS. 2 and 3, the contact surfaces 12 and 13 are separated from the arc running surfaces 14 and 15 surrounding the same by an annular gap 23. Helical cuts 22 which start a certain distance away from the outer edge of the contacts terminate in this gap.

As indicated in FIG. 2 by broken lines, upon the ignition of the arc, the current takes its course first in the axis of the contact arrangement in a straight line through the supporting pins 5 and 7. The arc 20 then is in the area of the central contact surfaces 12 and 13. But when the arc leaves these areas and migrates laterally to location 21, the current flows from the supporting pin 5 through the part 16 to the edge of the arc running surface 14 through the arc at location 21 and thence again through the edge of the arc running surface 15 and part 17 to the supporting pin 7. In this course, the current flows in a loop which exerts on the arc forces oriented inwardly, that is, forces directed towards the center of the contact arrangement. This prevents the arc from leaving the area between the contacts. As soon as the arc jumps the gap 23 and enters the central contact surfaces 12 and 13, further current supply through the edges of the arc running surfaces 14 and 15 ceases so that the current flows again through the contact surfaces 12 and 13, enabling the current loop to become effective which exerts on the arc forces directed outwardly. The arc is kept in motion by the alternation between current forces directed outwardly and inwardly.

The operating mode described above is promoted in particular by the feature that the annular gap 23 by itself effects a redirection of the current fed to the arc when the latter jumps from the central contact surfaces 12 and 13 to the arc running surfaces 14 and 15. The helical cuts 22 participate in the further operations in two ways, because they form guiding edges for the arc foot points on the one hand, and divide the arc running surface into fields on the other, as is evident particularly from FIG. 3. Therefore, the current can flow to the arc only through the edge zone of the particular field in which the foot point of the arc happens to be.

While the contacts 4 and 5 are shown in FIGS. 1 and 2 as forming integral parts with the supporting pins 5 and 7, a multi-part construction may also be selected in which, for example, the contact surface 12 including the arc running surface surrounding it and the bell-shaped part 16 form separate components connected to each other and to the supporting pin 5. This makes available the possibility of influencing the forces acting upon the arc by the selection of suitable materials and of appropriate dimensions of their cross-sectional areas.

What is claimed is:

1. A contact arrangement for a vacuum switch comprising contact members movable relative to each other for electrically opening and closing the vacuum switch, each of the contact members including a carrier and a contact piece mounted on said carrier, each of the contact pieces defining a centrally disposed contact surface, the contact surfaces of the contact pieces being mutually adjacent so as to be in mutual contact when the switch is closed and to conjointly define a gap when the vacuum switch is opened; each of the contact pieces having an arc running surface disposed in surrounding relation to the contact surface thereof; and, each of the contact pieces further including first current conducting means for directing current to the central contact surface thereof, and second current conducting means for supplying current to the arc running surface when the arc drawn between said contact pieces wanders outwardly from the central contact surface to the arc running surface whereby the current flowing to said arc running surface develops a force to urge the arc to remain in the region between the contact pieces as the arc moves toward the edge of the contact piece.

2. The contact arrangement of claim 1, said second current conducting means being a current conducting structure for directing current to the edge of the arc running surface.

3. The contact arrangement of claim 2, said structure having an annular section and being connected to the carrier for directing current from said carrier to the outer edge of the arc running surface.

4. The contact arrangement of claim 3, each of said contact pieces having an annular gap formed therein for separating the centrally disposed contact surface from the arc running surface.

5. The contact arrangement of claim 4, each of said contact pieces having a plurality of spiral shaped cuts formed in the arc running surface thereof, said spiral cuts communicating with said annular gap.

6. The contact arrangement of claim 1, each of said contact pieces having an annular gap formed therein for separating the centrally disposed contact surface from the arc running surface.

7. The contact arrangement of claim 6, each of said contact pieces having a plurality of spiral shaped cuts formed in the arc running surface thereof, said spiral cuts communicating with said annular gap.

* * * * *